United States Patent [19]

Jenkins

[11] 4,049,179

[45] Sept. 20, 1977

[54] TAG ATTACHING APPARATUS

[75] Inventor: William A. Jenkins, Englewood, Ohio

[73] Assignee: Monarch Marking Systems, Inc., Dayton, Ohio

[21] Appl. No.: 685,244

[22] Filed: May 11, 1976

[51] Int. Cl.[2] ..... B25C 1/00

[52] U.S. Cl. ..... 227/67

[58] Field of Search ..... 227/19, 67, 79, 80, 227/95, 124, 144

[56] References Cited

U.S. PATENT DOCUMENTS

| | | | |
|---|---|---|---|
| 3,734,375 | 5/1973 | Bone et al. | 227/67 |
| 3,759,435 | 9/1973 | Bone | 227/67 |
| 3,924,788 | 12/1975 | Furutu | 227/67 |
| 3,971,497 | 7/1976 | Hamisch, Jr. | 227/67 |

*Primary Examiner*—Granville Y. Custer, Jr.
*Attorney, Agent, or Firm*—Joseph J. Grass

[57] ABSTRACT

There is disclosed apparatus for attaching tags using fasteners of a type having a bar section and a button section joined by a filament section. Opposed operating levers are pivotally mounted on opposite sides of the body. Each lever carries a cam. A first carrier is mounted by the body and a second carrier is mounted by the first carrier. A push rod is connected to the second carrier. Each cam cooperates with a respective roller. A rack is secured to each body section and the second carrier has a pair of racks. Each gear meshes with a respective body section rack and a respective second carrier rack. A pawl is coupled to the first carrier. Action of the operating levers causes the cams to drive the first carrier. Movement of the first carrier causes the racks and gears to drive the push rod forward until the pawl is moved to a ready position. A spring acting on the first carrier returns the carriers, the levers and the push rod to their respective initial positions and moves the pawl away from its ready position to drive a toothed wheel of a fastener advancing means to bring a bar section of the next successive fastener into alignment with the needle bore.

31 Claims, 19 Drawing Figures

TAG ATTACHING APPARATUS

BACKGROUND OF THE INVENTION

1. Field of the Invention

This invention relates to tag attaching apparatus.

2. Brief Description of the Prior Art

The following U.S. patents showing various tag attaching apparatus are made of record:

| Patentee | U.S. Pat. No. | Date Granted |
|---|---|---|
| Flood | 2,626,393 | Jan. 27, 1953 |
| Weiland et al | 3,650,451 | March 21, 1972 |
| Bone et al | 3,734,375 | May 22, 1973 |
| Kinney et al | 3,735,908 | May 29, 1973 |
| Flood | 3,797,722 | March 19, 1974 |
| Bone | 3,880,339 | April 29, 1975 |
| Bone | 3,888,402 | June 10, 1975 |
| Furutu | 3,924,788 | Dec. 9, 1975 |

SUMMARY OF THE INVENTION

According to a specific embodiment of the invention, a body mounts a needle having a bore and a side opening communicating with the bore. A pair of opposed actuators are mounted by the body and are drivingly connected to a first carrier. The feature of a pair of actuators enables the apparatus to be held by the user in any convenient orientation. The body also mounts the first carrier which in turn mounts a second carrier. The second carrier is connected to a push rod. A fastener advancing means includes a toothed member and a pawl. The first carrier is coupled to the pawl through a lost-motion connection. The first carrier carries a pair of gears, the second carrier carries a pair of racks and a pair of racks are secured to the body. When the actuators are manually operated, the first carrier is driven and the second carrier is driven further than the first carrier through the gears and racks. When the push rod nears the end of its forward travel, the pawl is moved to a ready or cocked position. A spring returns the actuators, the push rod and the gears to their initial positions and as the carriers near the end of their retracting movement the pawl is driven to in turn drive the toothed member to advance a bar section of another fastener into alignment with the needle bore. The first carrier is preferably comprised of a pair of carrier members between which the second carrier is slidably mounted. A pair of rollers is mounted on a pin. The pin is connected to the carrier members and is guided by grooves in the body. Each actuator is preferably a lever which carries a cam cooperable with a respective roller. The spring is preferably connected to the pin midway between the carrier members and midway between the rollers. The body has body sections which are movable toward and away from each other during assembly or disassembly. The needle helps key the body sections together. As the pawl moves toward its ready position, a tooth of the pawl moves over a tooth on the toothed member and thereafter the pawl is cammed out of contact with the toothed wheel by a cam. When the pawl is driven away from the ready position, the pawl moves into contact with a tooth of the toothed member and as the pawl continues to move, the toothed member is rotated a sufficient extent to bring the bar section of the next fastener into alignment with the needle bore. By positioning the cam at the proper position relative to the path of travel of the pawl, the pawl can selectively engage every tooth, every other tooth, etc. to advance the toothed wheel with which it cooperates through the desired distance.

DETAILED DESCRIPTION OF THE PREFERRED EMBODIMENT

Figure 7:
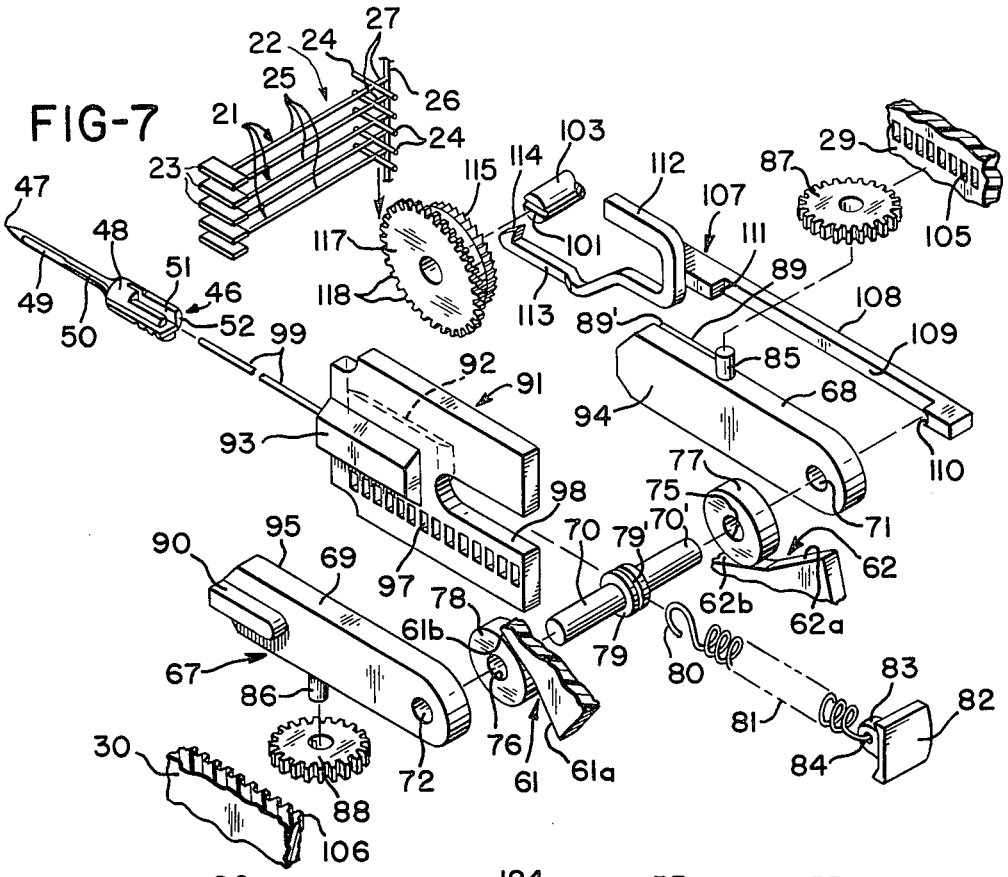
FIG. 7 is an exploded perspective view of certain of the operating components of the apparatus.
Figure 8:
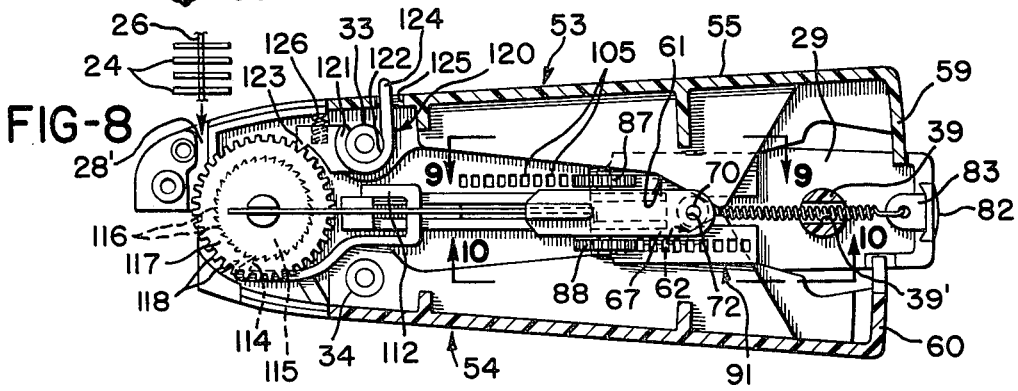
FIG. 8 is a side elevational view of the apparatus with one of the body sections removed.
Figure 9:
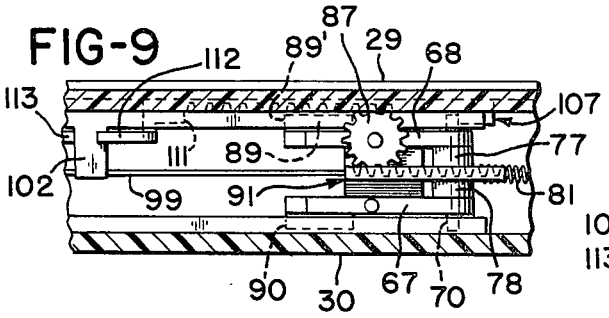
FIG. 9 is a sectional view taken along line 9—9 of FIG. 8.
Figure 10:
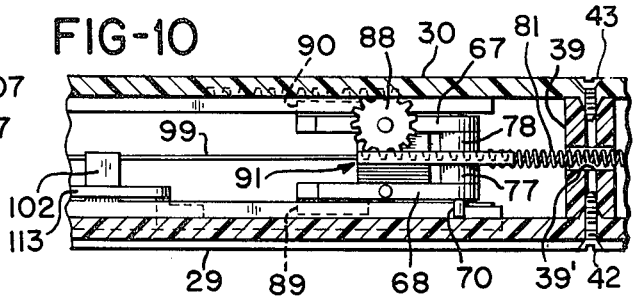
FIG. 10 is a sectional view taken along line 10—10 of FIG. 8.
Figure 11:
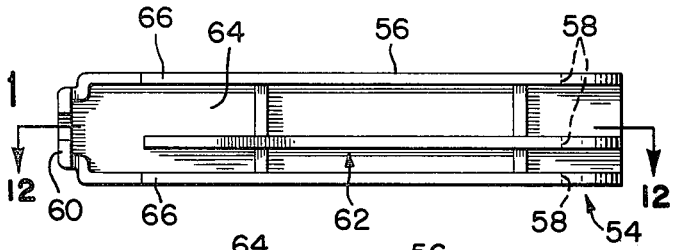
FIG. 11 is a top plan view of one of the actuators.
Figure 12:
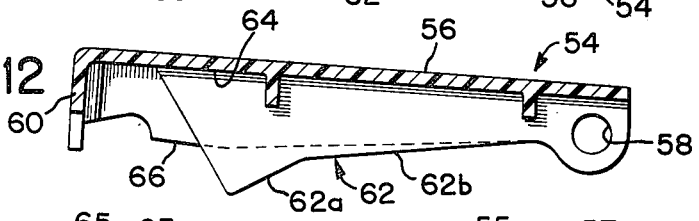
FIG. 12 is a sectional view taken along line 12—12 of FIG. 11.
Figure 13:
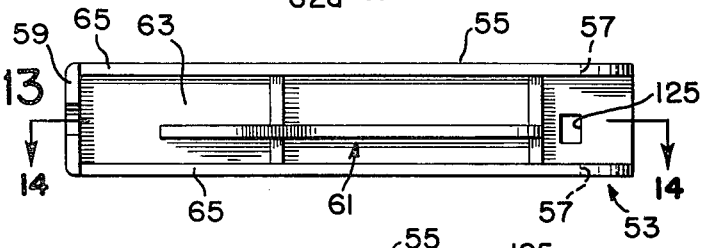
FIG. 13 is a bottom plan view of the other of the actuators.
Figure 14:
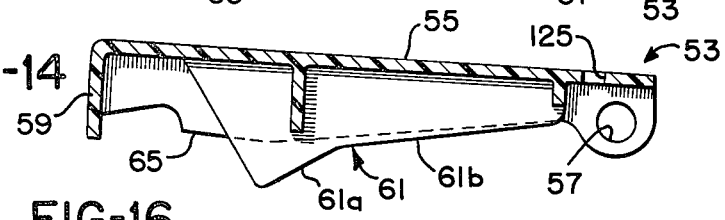
FIG. 14 is a sectional view taken along line 14—14 of FIG. 13.

Referring to the drawings, there is shown an attaching apparatus generally indicated at 20 for attaching tags (not shown) to merchandise (not shown) by fasteners 21 (FIGS. 7 and 8). The fasteners 21 are shown to be in an integral assembly 22 composed of molded plastics material. Each fastener 21 includes a head or button section 23, a bar section 24 and a filament or string section 25. The bar section 24 of each fastener 21 is connected to a runner or rod 26 by a respective connector 27.

Figure 1:
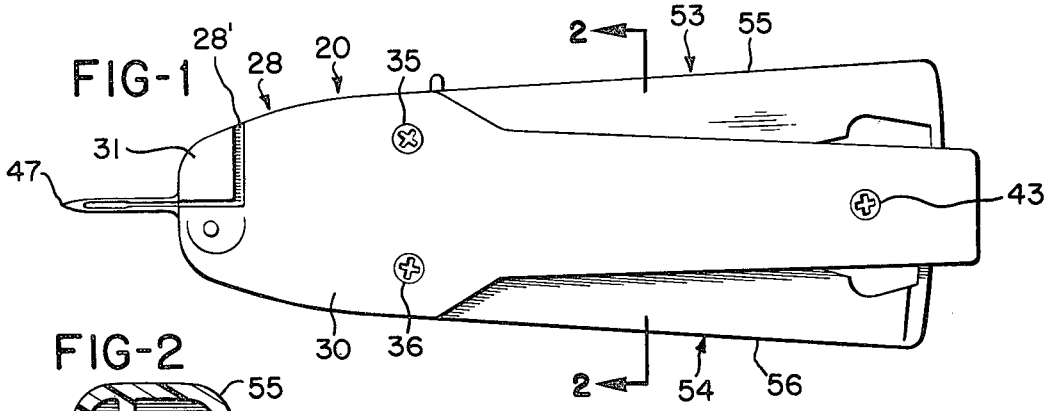
FIG. 1 is a left side elevational view of a tag attaching apparatus.
Figure 2:
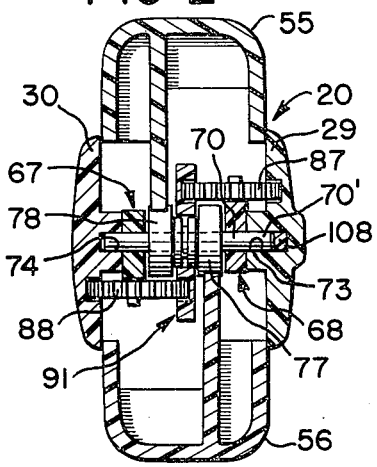
FIG. 2 is an enlarged sectional view taken generally along line 2—2 of FIG. 1.
Figure 3:
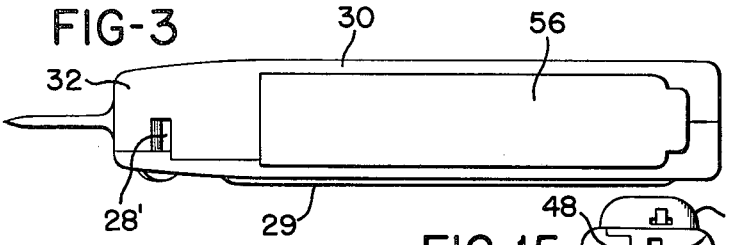
FIG. 3 is a bottom plan view of the apparatus on a smaller scale than FIG. 1.
Figure 15:
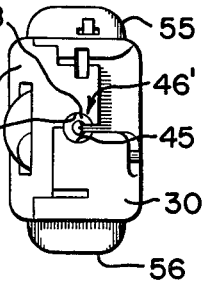
FIG. 15 is a front elevational view of the apparatus.
Figure 4:
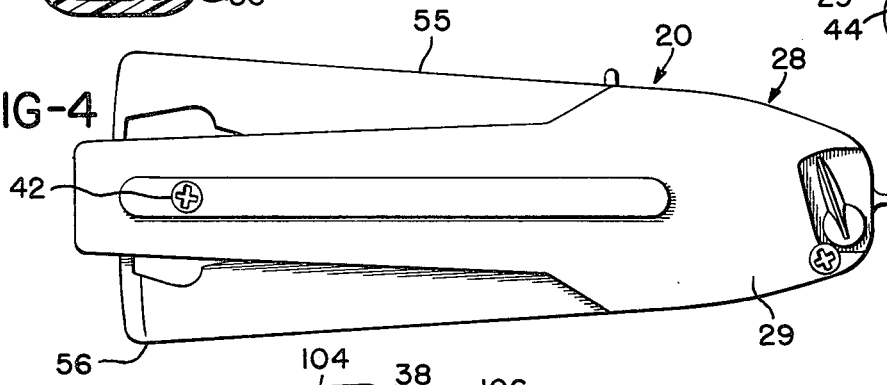
FIG. 4 is a right side elevational view of the apparatus.
Figure 5:
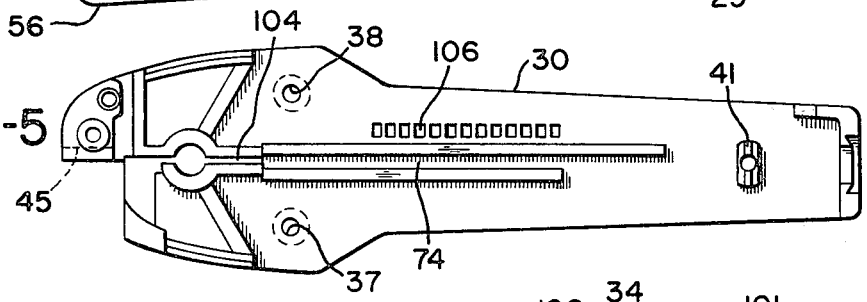
FIG. 5 is a side elevational view showing the inside configuration of one of the body sections.
Figure 6:
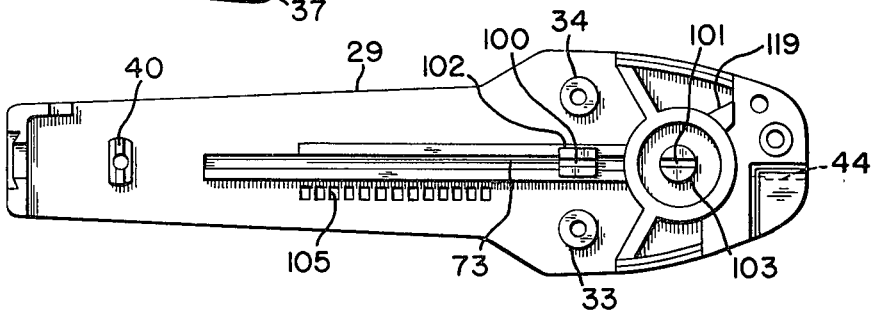
FIG. 6 is a side elevational view showing the inside configuration of another of the body sections.

The apparatus 20 is shown to include a body 28. It is preferred that the body 28 have two body sections 29 and 30. The body section 29 has a pair of parallel integrally formed posts 33 and 34 spanning the space between the body sections and between the front (left end portion on FIG. 1) and the rear (right end portion in FIG. 1) of the apparatus 20. Screws 35 and 36 pass through respective holes 37 and 38 in the body section 30 and are threadably received in the posts 33 and 34. A circular cylindrical spacer 39 has V-shaped grooves in its opposite ends which receive respective truncated V-shaped bosses 40 and 41. Screws 42 and 43 pass through respective holes in the sections 29 and 30 and are threadably received in the spacer 39. It is readily apparent that the body sections are securedly held together to provide a unitized construction. As best seen in FIG. 15, the body section 29 has an arcuate recess 44 and the body section 30 has an arcuate recess 45. The recesses 44 and 45 form a generally circular bore or hole 46' which receives a needle generally indicated at 46. The needle 46 (FIG. 7) has a pointed end 47 and an enlarged portion 48. The needle has an elongated bore 49, a side slot 50 which communicates with the bore 49 and a slot 51 through which a leading portion of the bar section 24 of a fastener descends into the bore 49. The enlarged portion 48 terminates at a cutting edge or knife 52, although a separate knife can be used. As shown in FIG. 15, the enlarged portion 48 of the needle 46 keys the body sections 29 and 30 together to resist being spread apart due to forces exerted by the user during operation.

The posts 33 and 34 are shown to movably mount actuators generally indicated at 53 and 54. The actuators 53 and 54 are preferably pivotally mounted for simplicity of construction and the actuators are shown to take the form of respective levers 55 and 56. The respective levers 55 and 56 are generally U-shaped in section. The lever 55 has aligned holes 57 which receive the post 33 and the lever 56 has aligned holes 58 which receive the post 34. The levers 55 and 56 are movable in the space between the body sections 29 and 30. The levers 55 and 56 have end walls 59 and 60 disposed at different distances from the axis of respective holes 57 and 58 so that the end walls 59 and 60 overlap and do not interfere with each other. The levers 55 and 56 carry respective cams 61 and 62. The cams 61 and 62 are preferably molded integrally with the respective bight portions 63 and 64 between the respective side wall portions 65 and 66.

With reference to FIG. 7, there is shown a carrier generally indicated at 67 which more specifically is a slide and which preferably includes spaced apart carrier members 68 and 69 which more specifically are slide members and a shaft or pin 70. The pin 70 extends through holes 71 and 72 in respective carrier members 68 and 69 and is guided for sliding movement in grooves 73 and 74 in respective body sections 29 and 30. The pin 70 extends through bores 75 and 76 in rollers 77 and 78. The cams 61 and 62 cooperate with respective rollers 78 and 77. A guide member or collar 79 which is preferably formed integrally with the shaft 70 is disposed midway between the ends of the pin 70 and has a continuous peripheral groove 79'. One curved end 80 of a tension spring 81 is received in the groove 79'. The groove 79' is slightly deeper and wider than the diameter of the wire from which the spring 81 is formed so that the end 80 extends slightly short of the outer annular periphery of the collar 79. A connector 82 has a tang 83 to which the other end 84 of the spring 81 is connected. The tang 83 fits through a cutout in the body 28 where the body sections 29 and 30 meet.

Annular posts 85 and 86 are connected to the carrier member 68 and 69. The posts 85 and 86 rotatably mount respective spur gears 87 and 88. It is apparent that the carrier members 68 and 69 are identical in construction although differently oriented. The members 89 and 90 project outwardly relative to each other and the axes of the posts 85 and 86 are parallel but the posts 85 and 86 extend in opposite directions. Members 89 and 90 are slidably received in respective grooves 73 and 74.

Figure 16:
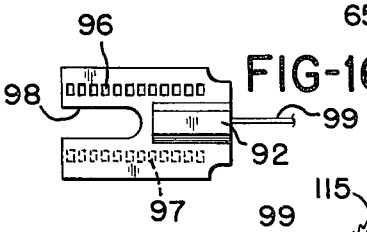
FIG. 16 is a side elevational view of a carrier and a fragmentary portion of the push rod shown in FIG. 7, for example.

A carrier generally indicated at 91 and more specifically a slide is slidably mounted by the carrier 67. The carrier 91 is shown to be on one-piece construction and to have guide surfaces 92 and 93. The surface 92 is in slidable contact with face 94 of the carrier member 68 and the surface 93 is in slidable contact with face 95 of the carrier member 69. The carrier 91 has rectilinear gear sections or racks 96 and 97. The racks 96 and 97 are shown to be disposed at opposite sides of the carrier 91. In the position shown in FIGS. 7 and 16, the rack 96 is located above the level of the faces 92 and 93 and the rack 97 is located below the level of the faces 92 and 93. The racks 96 and 97 are thus offset or staggered relative to each other. The carrier 91 has a slot or groove 98 which receives the guide member 79 and there is slidable contact between faces 92 and 93 and respective faces 94 and 95. The carrier 91 carries a push rod or ejector 99. The push rod 99 which is connected to the carrier 91 is guided in guideways 100 and 101 in respective posts 102 and 103 and in guideway 104 in the body section 30. Thus, because the guideways 100, 101 and 104 guide the push rod 99, they in turn also guide the carrier 91. The body sections 29 and 30 have respective integrally molded rectilinear gear sections or racks 105 and 106. The gear 87 meshes with racks 96 and 105 and the gear 88 meshes with the racks 97 and 106.

Figure 17:
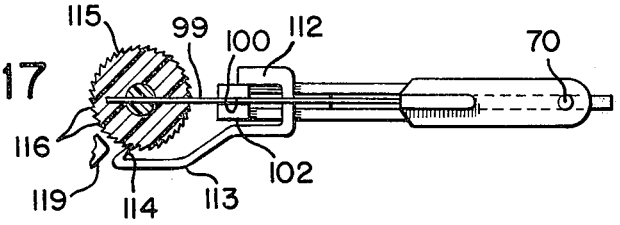
FIG. 17 is a fragmentary side elevational view partly in section showing the pawl in its fully retracted position and in contact with the ratchet wheel.
Figure 18:
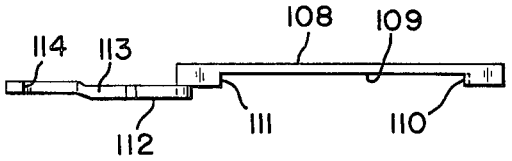
FIG. 18 is a top plan view of the pawl.

A pawl generally indicated at 107 is shown to be of one-piece construction. The pawl 107 is shown to have an elongated section or slide portion 108 which is slidably received in the groove 73. The slide portion 108 is shown to have a slot or cutout 109 having abutment faces 110 and 111. The portion 108 is connected to a pair of arms 112 and 113. The arm 113 has a tooth 114 disposed at its free end portion. The tooth 114 is cooperable with a toothed member 115 having a plurality of teeth 116. The toothed member 115 preferably takes the form of a ratchet wheel as shown in which the teeth 116 have a rake angle. The toothed wheel 115 is integrally connected to a toothed wheel 117 having teeth 118 (FIG. 7). The teeth 118 are cooperable with connectors 27 to advance the fastener assembly 22. Although it is preferred to utilize two toothed wheels 115 and 117, the apparatus 20 can be constructed using only one feed wheel (by a construction not shown) which serves both as a ratchet wheel and a feed wheel, as in U.S. Pat. No. 3,797,722, if desired. The pin 70 has an end portion 70' received in the slot 109. In the initial position, the end portion 70' of the shaft 70 is in contact with face 110 as shown in FIG. 17. In this position, the push rod 99 is shown to be retracted. When the carrier 67 is advanced, face 89' of the member 89 travels forward and eventually contacts face 111 and thus moves the pawl 107 forward to the ready or cocked position shown in FIG. 19, in which the arm 113 is shown cammed away from and out of contact with the toothed wheel 115 by cam 119 which may be formed integrally with the body section 29. The cam 119 is preferably disposed adjacent the outer periphery of the member 115 and adjacent the pawl 107. When the carrier 67 is retracted due to the urging of the spring 81, the portion 70' of the shaft 70 contacts the abutment face 110 and returns the pawl 107 to its initial or retracted position. As the pawl 107 moves from the position shown in FIG. 19 to the position shown in FIG. 17, the arm 113 rides off the cam 119 and picks up one tooth 116 and when the pawl 107 has returned to the initial position, the toothed wheels 115 and 117 have advanced through an angle that causes the bar section 24 of the next successive fastener 21 to be brought through the slot 51 into the bore 49 of the needle 46.

The position of the cam 119 can be changed by simply changing a slug in the mold (not shown) or by having the cam 119 removably mounted to the body section 29. By changing the position of the cam 119 the pawl 107 can pick up two or more teeth, or the teeth can be more widely spaced than in the illustrated embodiment and the pawl 107 can pick up one tooth 116 so that the toothed wheels 115 and 117 are rotated through a greater angle. This is advantageous when feeding a fastener assembly in which the bar sections 24 are more widely spaced apart as in U.S. Pat. No. 3,888,402. The effective length of travel of the pawl 107 and hence the amount of rotation of the toothed wheels 115 and 117 is thus governed by the position of the cam 119.

As shown, the elongated portion 108 is guided in the groove 73. The arm 113 is flexible and resilient. The post or guide 102 exerts a force on arm 112 which counteracts the force exerted by the toothed member 115 or the cam 119 on the arm 113, to prevent the slide portion 108 from deflecting and thus binding in the guideway or guide slot 73. The arm 112 is preferably made heavier is section than the arm 113 because the arm 112 should preferably deflect as little as possible and the arm 113 should be capable of the deflection illustrated in FIGS. 17 and 19.

A detent generally indicated at 120 is shown to include a body 121 having a hole or socket 122 received about the post 33. A tooth 123 is integrally connected to the body 121 and is shown to be in cooperation with the toothed member 117. An arm 124 extends through a hole 125 in the actuator 53. A spring 126 normally urges the tooth 123 into contact with the toothed wheel 117, but the arm 124 can be manually depressed which will cause the detent 120 to be pivoted clockwise about post 33 until the tooth 123 is clear of the teeth 118 of the wheel 117, thereby allowing the user to remove the fastener assembly 22 easily from the apparatus 20.

Figure 19:
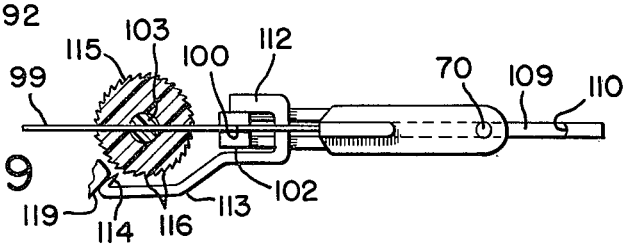
FIG. 19 is a view similar to FIG. 17 but showing the pawl in its fully extended or ready position.

In using the apparatus 20, and assuming the fastener assembly 22 has been inserted into guideway 28', the apparatus 20 can be grasped in any convenient orientation unlike an apparatus according to U.S. Pat. No. 3,924,788 which can be held in only one orientation in use. When the user squeezes the apparatus 20, the levers 55 and 56 pivot toward each other about respective pivots 33 and 34. The cams 61 and 62 act on respective rollers 78 and 77 thereby drive the carrier 67 in a forward direction, toward the left in FIG. 1 for example, against the force of the spring 81. Slopes or inclined portions **61*a* and 62*a* are steeper than slopes or inclined portions 61*b* and 62*b* so that a greater camming force is exerted on the rollers 78 and 77 and hence on the push rod 99 at the initial part of the cycle during which the knife 52 severs the bar 24 from the respective connectors. The double set of gearing represented by the set of gears 96, 87 and 105 and the set of gears 97, 88 and 106 provide a balanced drive and cause the carrier 91 to be driven through a greater distance than the distance through which the carrier 67 is driven. With the illustrated gearing, the carrier 91 moves twice as far as the carrier 67 because of the 2 to 1 gear ratio between rack gears 96 and 105 and between rack gears 97 and 106. This is advantageous because the push rod 99 is reguired to be driven through a considerably greater distance than the pawl 107. As the carriers 67 and 91 continue to move forward the drive face 89' contacts the face 111 and drives the pawl 107 from its initial position (FIG. 17) to the advanced or ready position (FIG. 19). The resilient arm 113 of pawl 107 has a face which rides along the cam 119 which causes the pawl tooth 114 to move out of contact with the toothed member 115. The fact that the length of travel of the pawl tooth 114 is considerably in excess of the travel required to advance the toothed member allows for greater manufacturing variations in the structure which determines pawl travel than would be the case if the pawl travel is only slightly greater than the tooth-to-tooth distance of the toothed wheel 115. When the pawl 107 is in the advanced position, the push rod 99 is fully forward and a fastener 21 has been dispensed from the needle 49. When the user relaxes his grip on the apparatus 20, the spring 81 pulls the carrier 67 to the retracted position, causing rollers 78 and 77 to drive the levers 55 and 56 outwardly to the position shown, causing the push rod 99 to be retracted, and causing the pawl 107 to ride off the cam 119 and engage precisely the correct tooth to drive the toothed wheel 115 to advance the fastener assembly 22.**

The apparatus of the invention is relatively economical to construct with body sections 29 and 30, levers 55 and 56, carrier members 68 and 69, rollers 77 and 78, member 82, gears 87 and 88, member 107, toothed members 115 and 117, and detent member 120 each being of one-piece molded plastics construction. The screws 35, 36 and 42, needle 46, pin 70, the guide member 79, the spring 81, the push rod 99 and the spring 126 being preferably constructed of suitable metals.

Other embodiments and modifications of this invention will suggest themselves to those skilled in the art, and all such of these as come within the spirit of this invention are included within its scope as best defined by the appended claims.

I claim:

1. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, the driving means including a carrier connected to the push rod, a first rack at one side of the carrier, a second rack at the other side of the carrier, third and fourth racks secured to the body, first gear means meshing with the first and third racks, second gear means meshing with the second and fourth racks, and means mounting the first and second gear means for translational and rotational movement.

2. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, wherein the driving means includes a first carrier slidably mounted by the body, a second carrier connected to the push rod and movably mounted by the first carrier, and gear means for drivingly coupling the body and second carrier.

3. Apparatus as defined in claim 2, including a lost-motion connection between the first carrier and the pawl.

4. Apparatus as defined in claim 2, wherein the gear means includes a rack on the body, a rack on the second carrier, and a gear rotatably mounted on the first carrier and in mesh with the racks.

5. Apparatus as defined in claim 2, wherein the driving means further includes an operating lever, cam means between the operating lever and the first carrier for driving the first carrier in one direction to effect movement of the push rod to push a bar section of a fastener through the needle bore, and wherein the driving means further includes a return spring for returning the first and second carriers, the gear means, the push rod, the cam means and the lever to their initial positions and for driving the pawl to effect advance of the toothed member to advance the fastener assembly.

6. Apparatus as defined in claim 2, wherein the driving means includes an actuator, a cam driven by the actuator and at least one roller carried by the first carrier and cooperable with the cam.

7. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pair of manually operable opposed actuators mounted for relative movement to the body for driving the push rod and for moving the pawl to a ready position with respect to the toothed member, and spring means for returning the actuators and the push rod to their initial positions and for moving the pawl to advance the toothed member.

8. Apparatus as defined in claim 7, wherein each actuator includes a lever pivotally mounted to the body.

9. Apparatus as defined in claim 7 wherein each actuator carries a cam, and means driven by the cams for operating the push rod and the pawl.

10. Apparatus for attaching tags using fasteners, each fastener including a bar section and a button section joined by a filament section, the apparatus comprising: a body having opposed body sections, a spacer disposed between the body sections, means for securing the spacer to the body sections to provide a unitized construction, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means including a slide for driving the push rod to push a bar section of a fastener through the needle bore and for thereafter returning the push rod and driving the pawl to drive the advancing means, a hole in the spacer, the driving means further including a tension-type return spring extending through the hole in the spacer and connected at one end to the body and at its other end to the slide.

11. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, a post connected to the body, wherein the pawl includes a one-piece member including an elongated section having a cutout providing a pair of spaced-apart abutment faces, an arm in guided contact with the post and a flexible resilient arm having a tooth cooperable with the toothed member, the driving means including means cooperable with the abutment faces for moving the pawl in opposite directions.

12. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, a post connected to the body, and a groove in the post for guiding the push rod, the pawl having a portion in guided contact with the post.

13. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, wherein the body includes guide means, the pawl including a slide portion in slidable and guided contact with the guide means, a first flexible resilient arm having a tooth cooperable with the toothed member, and a second arm cooperable with the guide means for counteracting the force exerted on the first arm by the toothed member and for preventing the slide portion from binding in the guide means.

14. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, wherein the driving means includes a first slide having a pair of individual spaced-apart slide members guided for straight line movement by the body, a second slide carried by the first slide, disposed between the slide members and connected to the push rod, and means coupling the slides for relative movement with respect to each other.

15. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, the driving means including a pair of levers mounted on the body for movement relative to each other and relative to the body, a carrier connected to the push rod, and means driven by the levers for driving the carrier.

16. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, the driving means including a pair of levers mounted on the body for movement relative to each other and relative to the body, a carrier, a lost-motion connection between the carrier and the pawl, and means driven by the levers for driving the carrier.

17. Apparatus as defined in claim 16, wherein the driving means further includes gearing driven by the carrier for driving the push rod through a greater distance than the distance through which the carrier travels.

18. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pair of levers mounted on the body for movement relative to each other and relative to the body, and means including cams driven by the respective levers for driving the push rod and the pawl.

19. Apparatus for attaching tags using an assembly of fasteners, each fastener including a bar section and a button section joined by a filament section, a runner, and a connector individual to each fastener connecting the respective bar sections to the runner, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, a knife for severing the bar sections from the respective connectors, the driving means including a pair of manually operable actuators, a cam driven by each actuator, each cam having a variable rate profile, the respective profile being the steepest at the beginning of the operational cycle of the actuator when the knife is severing a bar section from the respective connector.

20. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, a pair of levers mounted on the body for movement relative to each other, gearing driven by the levers for driving the push rod to push a fastener through the needle bore, and means drivingly coupling the levers and the pawl.

21. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl movable in opposite directions for driving the toothed member, means for driving the pawl and the push rod, a cam cooperable with the pawl for camming the pawl out of contact with the toothed member during movement of the pawl in one direction and movable into contact with the toothed member during movement of the pawl in the opposite direction to move through an effective distance in which the toothed member is driven, the cam being positioned adjacent the outer periphery of the toothed member to cause the pawl to drive the toothed wheel through the desired effective distance, and means guiding the pawl for straight line movement in the body.

22. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl movable in opposite directions for driving the toothed member, the pawl having a tooth cooperable with the toothed member, a cam separate from and adjacent the pawl, means for driving the push rod to push a bar section of a fastener through the needle bore and for driving the pawl through a greater distance than required to advance the toothed wheel to cause the pawl to cooperate with the cam to cam the pawl out of contact with the toothed wheel when the pawl moves in the one direction and to thereafter cause the pawl to be cammed into contact with the toothed member when the pawl moves in the opposite direction to in turn drive the toothed member the required distance to bring the bar section of the next fastener into alignment with the needle bore, and the pawl including means for resiliently urging the pawl tooth into contact either with the toothed member or with the cam.

23. Apparatus as defined in claim 22, wherein the cam is disposed adjacent the outer periphery of the toothed member.

24. Apparatus as defined in claim 22, wherein the pawl is of one-piece plastics construction.

25. Apparatus as defined in claim 22, wherein the urging means includes a flexible resilient arm to which the pawl tooth is connected.

26. Apparatus as defined in claim 22, wherein the cam is disposed adjacent the outer periphery of the toothed member, and wherein the urging means includes a flexible resilient arm to which the pawl tooth is connected.

27. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed wheel, a pawl for driving the toothed wheel, means for driving the push rod and the pawl, a post for rotatably mounting the toothed wheel to the body, and a guide groove in the post for guiding the push rod for straight line movement.

28. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, the driving means including a carrier and means including gearing coupling the carrier and the push rod, wherein the driving means further includes a lost-motion connection between the carrier and the pawl, wherein the carrier includes a pair of spaced apart carrier members slidably mounted in the body, a pin extending through the carrier members and guided by the body, and rollers mounted on the pin between the carrier members, a pair of actuators mounted to the body, cams carried by the respective actuators and cooperable with the respective rollers for driving the carrier in one direction, and spring means for returning the carrier, the push rod, the gearing and the actuators to their initial positions and for driving the pawl through the lost-motion connection.

29. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, the driving means including a carrier and means including a gearing coupling the carrier and the push rod, in which the carrier includes a pair of spaced apart slide members slidably mounted in the body, each slide member having a post, a gear rotatably mounted on each post, the body having body sections, a rack secured to one body section, another rack secured to another body section, each gear meshing with a respective body section rack, and spaced apart racks connected to each other and to the push rod, each push rod rack meshing with a respective gear.

30. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, wherein the driving means includes a slide and includes a carrier connected to the push rod and movable mounted by and relative to the slide, the body including guideway means, the slide including means received in the guideway means for guiding the slide, and means coupling the slide and the carrier for relative movement with respect to each other, the pawl having a portion received in the guideway means, a lost-motion connection between the slide and the pawl, and the guiding means includes a pin having end portions received in the guideway means, the carrier having a slot, the pin being received in the slot for guiding the carrier.

31. Apparatus for attaching tags using fasteners, each fastener including a bar section and a button section joined by a filament section, the apparatus comprising: a body, a needle mounted by the body and having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a pawl for driving the toothed member, means for driving the push rod and the pawl, wherein the driving means includes a slide and includes a carrier connected to the push rod and movably mounted by and relative to the slide, the body including guideway means, the slide including means received in the guideway means for guiding the slide, and means coupling the slide and the carrier for relative movement with respect to each other, the pawl having a portion received in the guideway means, wherein the guiding means includes a pin having end portions received in the guideway means, and a lost-motion connection between the slide and the pawl.

* * * * *